United States Patent [19]

Tanaka

[11] Patent Number: 4,845,320

[45] Date of Patent: Jul. 4, 1989

[54] TIME DIFFERENCE SWITCH

[75] Inventor: Masao Tanaka, Tokyo, Japan

[73] Assignee: Metro Denso Kabushiki Kaisha, Kawasaki, Japan

[21] Appl. No.: 157,721

[22] Filed: Feb. 22, 1988

[51] Int. Cl.[4] ..... H01H 9/00; H01H 13/64

[52] U.S. Cl. ..... 200/1 B; 200/508

[58] Field of Search ..... 200/1 R, 1 A, 1 B, 1 TK, 200/5 R, 6 R, 6 B, 6 BA, 6 BB, 6 C, 33 R, 80 R, 80 A, 159 R, 159 A, 67 D, 67 DA; 337/87–89

[56] References Cited

U.S. PATENT DOCUMENTS 2,649,520 8/1953 Hartz ..... 200/67 DA 2,788,419 4/1957 Young ..... 200/67 D 3,809,838 5/1974 Coppola ..... 200/159 R 4,129,763 12/1978 Murata ..... 200/159 R X

*Primary Examiner*—J. R. Scott

*Attorney, Agent, or Firm*—Wenderoth, Lind & Ponack

[57] ABSTRACT

A time difference switch turns on and off two electric circuits, under the operation of a common operating member, with an adequate time difference. The section of the switch that defines a step dimension that facilitates the time difference is relatively short, and for this reason, the likelihood of a change in the predetermined step dimension, i.e., in the time difference, is lessened. Thus, a time difference switch providing a predetermined accurate time difference is provided.

2 Claims, 2 Drawing Sheets

TIME DIFFERENCE SWITCH

BACKGROUND OF THE INVENTION

The present invention relates to a switch for turning on and off two electric circuits by operating a common push member, particularly a time difference switch which turns on and off the respective circuits with an adequate time difference.

For example, when a driver driving an automobile in the daytime is going to inform the driver of another car ahead of him of his intention to pass, the upper head light, in other words the passing head light, is lit. For lighting the head light, two electric circuits, namely a circuit connecting the head light to the power source and a circuit for selecting the head light, are switched on and off by operating a common operating member, and in this case, a time difference switch providing an adequate time difference is used. In the conventional time difference switch for example, as shown in FIG. 7, conductive elastic movable pieces 1*a* and 1*b*, respectively associated with the two electric circuits, are united at one end and fastened to a switch base 3 at said one end 2. And, at the respective other ends, movable contacts 5*a* and 5*b* are provided to respectively move into and out of contact with the fixed contacts 4*a* and 4*b* set on the switch base 3. In addition, one of the elastic movable pieces 1*a*, 1*b* is provided with a step 6 extending toward the corresponding fixed contact 4*b*. The elastic movable pieces 1*a* and 1*b* are moved simultaneously toward the switch base 3 by a common push member 7, causing the respective movable contacts 5*a* and 5*b* to contact the corresponding fixed contacts 4*a* and 4*b*, for switching the circuits on. In this case, since the movable contact 5*b* of the elastic movable piece 1*b* with the step 6 contacts the fixed contact 4*b* before the movable contact 5*a* of the elastic movable piece 1*a* not provided with the step 6 contacts fixed contact 4*a*, an adequate time difference in switching on and off the two circuits is facilitated. Therefore, to ensure the adequate time difference, the step dimension must be accurately maintained.

In such a switch, said elastic movable pieces 1*a* and 1*b* are required to have a certain length, to maintain predetermined distances between the movable contacts 5*a* and 5*b* and the fixed contacts 4*a* and 4*b* during the switching off of the circuits, and to lessen the deformation of said elastic movable pieces 1*a* and 1*b* at said one end 2 caused by every switching on and off operation, for preventing the permanent deformation and fatigue failure of the elastic movable pieces 1*a* and 1*b* due to a large amount of strain. Furthermore, the sections s between the pressure points of the elastic movable pieces 1*a* and 1*b* at which the push member 7 exerts pressure and the movable contacts must also have a certain length, to establish a predetermined contact pressure and push force.

The sections s between the pressure points of the elastic movable pieces 1*a* and 1*b* at which the push member 7 exerts pressure and the movable contacts 5*a* and 5*b* are separated, and the step difference must be established over the entire sections s which are relatively long. For this reason, relative separation of said elastic movable pieces 1*a* and 1*b* due to the deformation thereof caused during production, handling, transport, etc. is liable to be large, and thus there arises a problem in that a change in step dimension and thus in time difference also becomes large. In addition, the conventional switch has another problem in that a forked push member or a push member straddling both elastic movable pieces 1*a* and 1*b* is required for simultaneously pushing both elastic movable pieces 1*a* and 1*b*.

SUMMARY OF THE INVENTION

In the present invention, the section of the switch over which the step dimension is established is relatively short compared with the section in the conventional switch, and for this reason a change in the predetermined step dimension, i.e., in the time difference, can be prevented. Thus, the present invention provides a switch in which an adequate accurate time difference can be provided. Furthermore, in the present invention, since the pressure point of the elastic movable piece at which the push member exerts pressure is common to the respective movable contacts, unlike the conventional switch, a forked push member or a push member straddling a pair of elastic movable pieces for simultaneously pushing both elastic movable pieces is not required. Thus, the present invention provides a relatively compact switch.

BRIEF DESCRIPTION OF THE DRAWINGS

The present invention is described below in detail with reference to the accompanying drawings, which show preferred embodiments.

DETAILED DESCRIPTION OF THE PREFERRED EMBODIMENTS

Figure 1:
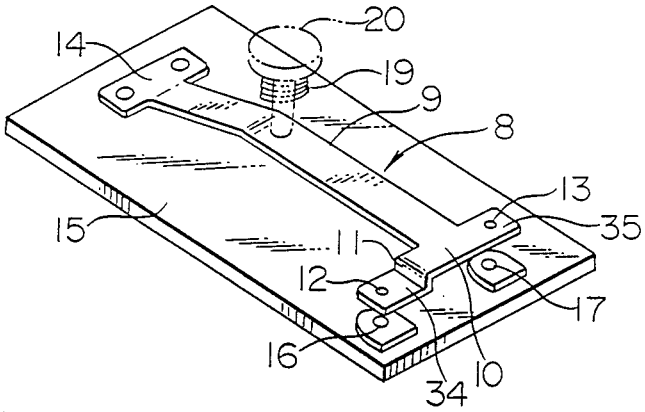
FIG. 1 is a perspective view of the time difference switch according o the invention.
Figure 2:
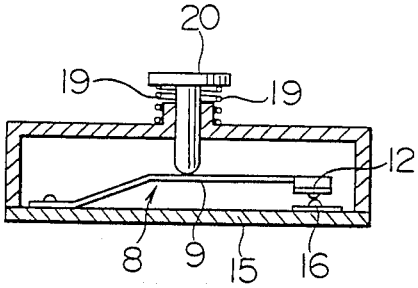
FIG. 2 is a sectional side view of the time difference switch shown in FIG. 1.
Figure 3:
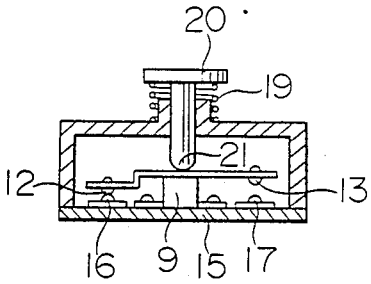
FIG. 3 is a sectional front view of the time difference switch shown in FIG. 1.

The present invention is described below with reference to FIGS. 1 through 3 showing a preferred embodiment. The time difference switch of the present invention comprises a conductive elastic piece 8 fastened at one end 14 to a switch base 15 and provided with a pair of movable contacts 12 and 13 at the other end, and a pair of fixed contacts 16 and 17 provided on said switch base 15 respectively associated with said pair of movable contacts 12 and 13, wherein said elastic movable piece 8 includes a common strip portion 9 extending from said one end 14 to the said other end 10 and protrusion portions 34 and 35 protruding from the other end of the said strip portion 9 crosswise on both sides. One of said protrusion portions 34 and 35 has a step 11 extending toward the fixed contact associated therewith. Said protrusion portions 34 and 35 are provided with said pair of movable contacts 12 and 13 at respective locations thereon disposed at different levels due to the step 11; and a push member 20 is provided at a proper position for actuating said strip portion 9.

If the strip portion 9 is pressed at a proper point by the push member 20, the protrusion portions 34 and 35 protruding from the other end of the strip portion 9 crosswise on both sides move simultaneously toward the switch base 15. At first, the movable contact 12 of the protrusion portion 34 provided with the step 11 extending toward the fixed contact 16 contacts the fixed contact 16 for switching a circuit on, and by further pressing the strip portion 9 at the proper point, the movable contact 13 of the protrusion portion 35 not provided with the step 11 also finally contacts the corresponding fixed contact 17 for switching another circuit on. Then, if the pressure exerted on the push member 20 is released, the push member 20 returns to the original position under the action of a return spring 19, simultaneously causing the elastic movable piece 8 to return. At first, the movable contact 13 of the protrusion portion 35 not provided with the step 11 leaves the fixed contact 17 for switching the circuit off, and then, the movable contact 12 of the protrusion portion 34 provided with the step 11 leaves the corresponding fixed contact 16 for switching the other circuit off. Thus, an adequate time difference for switching the circuits on and off can be obtained.

Since the pressure point of the elastic movable piece 8 at which the push member 20 exerts pressure is on the strip portion 9 containing the respective movable contacts 12 and 13, the section from the pressure point to the other end 10 of the strip portion 9 does not establish the step dimension, and only the section between the movable contacts 12 and 13 in the protrusion portions 34 and 35 protruding on both sides of the other end of the strip portion 9 defines the step dimension. If the length of the elastic movable piece 8 and the pressure point of the elastic movable piece 8 at which the push member 20 exerts pressure are compared with the conventional switch, the distance between the movable contacts 12 and 13 in the present invention, i.e., the section establishing the step dimension is shorter than the conventional section. For this reason, the present invention can provide a switch which can easily reduce the possibility of a change in predetermined step dimension, i.e., in time difference, and thus assures an adequate accurate time difference. Furthermore, since the pressure point of the elastic movable piece 8 at which the push member 20 exerts pressure is on the strip portion 9 containing the respective movable contacts 12 and 13, the present invention does not require a forked push member or a push member straddling a pair of elastic movable pieces required hitherto for simultaneously pushing the pair of elastic movable pieces. Thus, the present invention provides a switch that is relatively compact.

Figure 4:
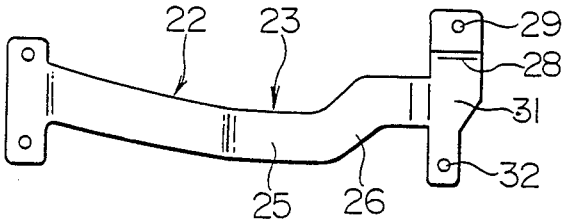
FIG. 4 is a plan view of another embodiment of the elastic movable piece used in the switch of the present invention.
Figure 5:
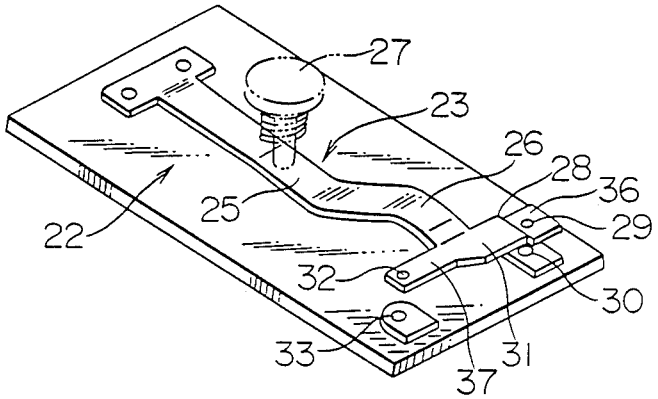
FIG. 5 is a perspective view of the time difference switch using the elastic movable piece shown in FIG. 4.

In the preferred embodiment described above, the strip portion 9 is straight, but in the embodiment shown in Figs. 4 and 5, the strip portion 26 has a curved section 23, to align the pressure zone 25 of the elastic moving piece 22 at which the push member 27 exerts pressure with the movable contact 32 of the protrusion portion 37 not provided with the step 28.

This embodiment will be further described below with reference to FIGS. 4 and 5. The switch of this embodiment comprises a conductive elastic movable piece 22 fastened at one end to a switch base and provided with a pair of movable contacts 29 and 32, and a pair of fixed contacts 30 and 33 provided on the switch base and respectively associated with the pair of movable contacts 29 and 32. The elastic movable piece (22) includes a common strip portion 26, extending from one end to the other end of the movable piece with almost all of its middle portion (25) formed as a curved section (23) protruding toward the movable contact 32 of the protrusion portion 37 not provided with the step 28, protrusion portions 36 and 37 protruding from the other end (31) of the movable piece crosswise. One of the protrusion portions 36 and 37 has a step 28 extending toward the corresponding fixed contact 30. The protrusion portions 36 and 37 are provided with the pair of movable contacts 29 and 32 at respective locations disposed thereon at different levels due to the step 28. A push member 27 is provided at a proper point for actuating the strip portion 26.

In this embodiment, after the movable contact 29 in the protrusion portion 36 provided with the step 28 has contacted the fixed contact 30, it becomes easy to establish contact between the movable contact 32 in the other protrusion portion 37 and the fixed contact 33. The reason for this is that the moment arm for deflecting the strip portion 26 is large since the pressure point 25 of the elastic movable piece 22 at which the push member 27 exerts pressure is spaced a significant distance across from the movable contact 29 in contact with the fixed contact 30.

Figure 6:
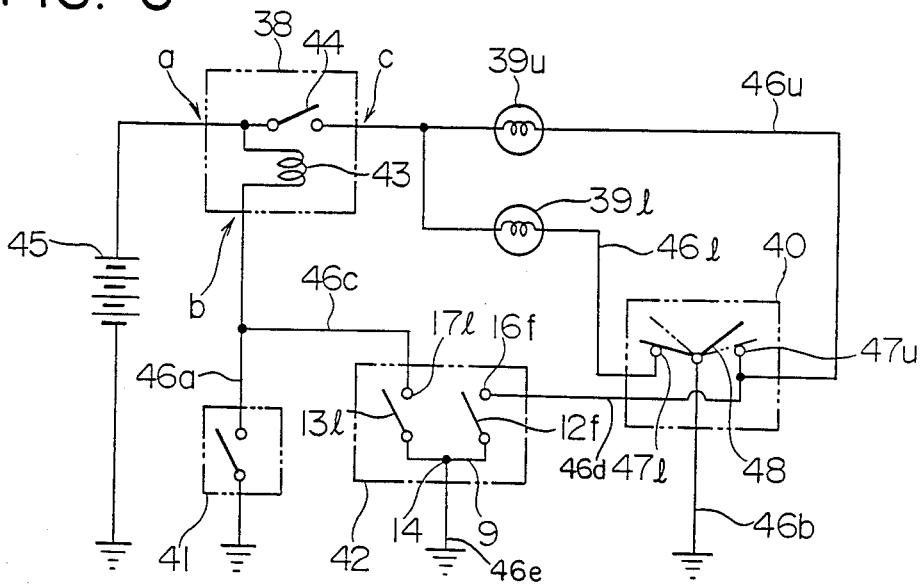
FIG. 6 is a circuit diagram of a circuit for illuminating the head lights of an automobile using the time difference switch shown in FIG. 1.
Figure 7:
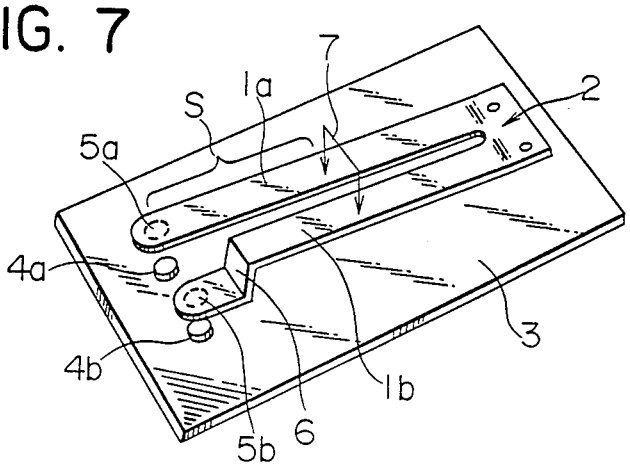
FIG. 7 is a perspective view of a conventional time difference switch.

FIG. 6 shows a circuit for illuminating the head lights of an automobile using a time difference switch of the present invention.

This lighting circuit comprises a relay (38), a lower head light ($39_l$), an upper head light ($39^u$) usable also as a passing light, a dimmer switch (40) for switching between the lights ($39_l$) and $39_u$), a head light switch (41), a time difference switch (42) of the present invention, and wiring connecting these elements.

In FIG. 6, the time difference switch (42) preferably comprises the type shown in FIG. 1, and therefore the symbols in this figure stand for the corresponding parts in FIG. 1.

The relay (38) is provided with a relay coil (43) and contact (44) to be closed when the relay coil (43) is energized. The relay coil (43) and the contact (44) are connected on the supply side (a) to the power source (45). On the other side (b) of the relay coil (43), the relay is grounded by wiring (46*a*) through said head light switch (41).

On the other hand, on the other side (c) of the contact (44), the relay is connected with branched wiring ($46_l$) and ($46_u$) respectively connected with the lower head light ($39_l$) and the upper head light ($39_u$). The wiring ($46_l$) and ($46_u$) through the lower and upper head lights ($39_l$) and ($39_u$) is connected with respective fixed contacts ($47_l$) and ($47_u$) to be in selective contact with a moving contact (48). The moving contact (48) is grounded by wiring ($46_b$).

Wiring ($46_c$) is connected on one side with the wiring ($46_a$) between the relay coil (43) and the head light switch (41) and is connected on the other side with a fixed contact ($17_l$) provided on the switch base 15 (shown in FIGS. 1–3) of the time difference switch (42). Wiring ($46_d$) is connected on one side with the fixed contact ($47_u$) connected to the upper head light ($39_u$), is connected on the other side with the other fixed contact (16) of the time difference switch (42), and is grounded by wiring ($46_e$) connected to the base end (14) of a conductive elastic piece (9).

If the head light switch (41) is closed, the relay coil (43) is energized to close the contact (44). If the contact (44) is closed, current flows through one of the head lights ($39_u$) and ($39_l$) depending on the state of the dimmer switch (40). In the state indicated by solid lines in FIG. 6, that is, when the moving contact (48) is in contact with the fixed contact ($47_l$), the lower head light ($39_l$) goes on. And, in the state indicated by two-dot-dash lines in FIG. 6, that is, when the moving contact (48) is in contact with the fixed contact ($47_u$), the upper head light ($39_u$) goes on. In this way, the head lights can be switched, depending on the presence of cars traveling in the opposite lane.

While driving in the daytime, when the driver is going to inform the driver of another car ahead of him of his intention to pass, the upper head light ($39_u$) is lit. However, since the head light switch (41) is open as shown in FIG. 6 while driving in the daytime as a matter of course, operating the dimmer switch (40) alone does not cause the head light ($39_u$) to go on. Furthermore, when the dimmer switch (40) is in the state shown by the solid lines in FIG. 6, closing the head light switch (41) causes the lower head light ($39_l$) to go on, and it is not possible to cause the intended upper head light ($39_u$) to go on by performing a single action.

Therefore, in this case, the time difference switch (42) of the present invention serves as a passing switch.

In the state shown by the solid lines in FIG. 6, if the time difference switch (42) is closed by said press member, at first, the moving contact ($12_f$) contacts the corresponding fixed contact ($16_f$) to form a ground circuit including the head light ($39_u$) independent of the dimmer switch (40).

Then, after the lapse of an adequate period of time, the other moving contact ($13_l$) contacts the corresponding fixed contact ($17_l$) to form a ground circuit including the relay coil (43). For this reason, even though the head light switch (41) is open, the circuit thus established causes the relay coil (43) to be energized to close the contact (44).

Therefore, irrespective of the state of the dimmer switch (40), the current flows through the upper head light ($39_u$) to light it. Thus, simply by operating the passing switch, i.e., the time difference switch (42) of the present invention, the intended upper head light ($39_u$) can be positively lit. When the dimmer switch (40) is in the state indicated by the solid lines in FIG. 6, the lower head light ($39_l$) is illuminated in addition to the upper head light ($39_l$), but this additional lighting does not bring about any inconvenience in achieving the object of letting the driver of the car ahead know of the intention of passing.

For resetting the passing switch, at first the relay coil (43) is de-energized to open the contact (44), and the ground circuit corresponding to the upper head light ($39_u$) is opened.

As can be seen, the time difference switch (42) of the present invention acts to provide a time difference between the establishment and opening of the ground circuit corresponding to the upper head light ($39_u$) and the establishment and opening of the ground circuit corresponding to the relay coil (43). That is, the switch assures that the ground circuit including the relay coil (43) is established and opened only when the ground circuit including the upper head light ($39_u$) is established. In other words, the ground circuit including the upper head light ($39_u$) is established and opened only when the ground circuit including the relay coil (43) is opened.

When the contacts ($16_f$) and ($12_f$) move into and out of contact, current does not flow through the head lights ($39_u$) and ($39_l$) and therefore, no arc is generated at all irrespective of the operating speed of the time difference switch (42) to prevent the contacts (16) and ($12_f$) from being worn. The current fed through the head lights ($39_u$) and ($39_l$) is turned on and off by closing and opening the contact (44). However, since the operation for closing and opening the contact (44) is not manual, the current can always be turned on and off in a quick manner to inhibit the generation of arc and to therefore reduce wear. Furthermore, since the current for closing and opening the contacts ($17_l$) and ($13_l$) is so small as to only energize the relay coil (43), the wear of the contacts ($17_l$) and ($13_l$) is practically negligible.

On the other hand, when the closing or opening of the contacts ($16_f$) and ($12_f$) and the closing or opening of the contact (44) occur simultaneously, or when the contacts ($16_f$) and ($12_f$) are closed or opened after the contact (44) has been closed or opened, an arc is generated at the contacts ($16_f$) and ($12_f$), depending on the closing or opening speed, and wear is liable to take place. Therefore, the step dimension of the time difference switch (42) must be maintained to always provide an adequate time difference.

Since the time difference switch (42) of the present invention allows the step dimension to be maintained as mentioned above, it can be used as the above-mentioned lighting circuit for head lights, while effectively preventing the wear of contacts and enhancing the durability in general.

Although the invention has been described and exemplified by way of specific embodiments, it is not intended that it be limited thereto. As will be apparent to those skilled in the art, numerous modifications and variations of these embodiments can be made without departing from the spirit of the invention or the scope thereof as defined in the following claims.

What is claimed:

1. A time difference switch comprising:

a switch base;

a pair of fixed contacts fixed on said switch base;

a conductive elastic piece mounted on said switch base, said conductive elastic piece having a first end at which said piece is fixed to said base, a free end, a strip extending between and integral with said first end and said free end, a pair of protrusions respectively extending from said free end at opposite sides thereof in a direction generally transverse to a direction taken between said first and said free ends, and a pair of movable contacts each of which is disposed on a respective one of said protrusions, said conductive elastic piece biased to a first position at which said free end is disposed above said switch base, each of said movable contacts operatively associated with and disposed generally directly across from a respective one of said fixed contacts when said elastic piece is in said first position, one of said protrusions having a stepped portion, the movable contact disposed on said one of said protrusions being spaced a first distance from the fixed contact operatively associated therewith by said stepped portion when said elastic piece is at said first position, and the movable contact disposed on the other of said protrusions being spaced a second distance, that differs in amount from said first distance, from the fixed contact operatively associated therewith, said elastic piece movable from said first position to at least a second position at which one of said movable contacts is in contact with the fixed contact operatively associated with said one of said movable contacts while the other of said movable contacts is out of contact with the fixed contact operatively associated with said other of said movable contacts, said elastic piece movable to a third position thereby causing engagement of the other of said movable contacts with the fixed contact operatively associated with said other of said movable contacts, and a push member movably mounted in the switch for moving said conductive elastic piece between said first, second and third positions.

2. A time difference switch as claimed in claim 1, wherein said strip has a middle portion that is generally curved, extending away from said free end toward the movable contact disposed on the other of said protrusions and then toward said free end, and said push member engages said conductive elastic piece at the middle portion of said strip.

* * * * *